US011742123B2

(12) United States Patent
Lisec et al.

(10) Patent No.: US 11,742,123 B2
(45) Date of Patent: Aug. 29, 2023

(54) METHOD OF PRODUCING AN OPPOSITELY MAGNETIZED MAGNETIC STRUCTURE

(71) Applicant: Fraunhofer-Gesellschaft zur Förderung der angewandten Forschung e.V., Munich (DE)

(72) Inventors: Thomas Lisec, Itzehoe (DE); Fabian Lofink, Itzehoe (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 327 days.

(21) Appl. No.: 16/919,145

(22) Filed: Jul. 2, 2020

(65) Prior Publication Data

US 2021/0082611 A1 Mar. 18, 2021

(30) Foreign Application Priority Data

Jul. 10, 2019 (DE) ..... 102019210177.1

(51) Int. Cl.
*H01F 7/06* (2006.01)
*H01F 7/02* (2006.01)
(Continued)

(52) U.S. Cl.
CPC ..... *H01F 7/0273* (2013.01); *H01F 1/0027* (2013.01); *H01F 1/0571* (2013.01); *H01F 41/0253* (2013.01); *H01F 41/22* (2013.01)

(58) Field of Classification Search
CPC ... H04L 5/0026; H04L 5/0035; H04L 5/0048; H04L 5/0091; H04L 5/14; H04L 27/0008;
(Continued)

(56) References Cited

U.S. PATENT DOCUMENTS 5,396,136 A 3/1995 Pelrine et al.
7,428,092 B2 * 9/2008 Lee ..... G02B 26/0841 359/290
(Continued)

FOREIGN PATENT DOCUMENTS

CN 102939620 A 2/2013
CN 105074785 A 11/2015
(Continued)

OTHER PUBLICATIONS

Chinese language Notice of Allowance dated Sep. 20, 2022, issued in application No. CN 202010649585.5.
(Continued)

*Primary Examiner* — Paul D Kim
(74) *Attorney, Agent, or Firm* — McClure, Qualey & Rodack, LLP

(57) ABSTRACT

A method of producing an oppositely magnetized magnetic structure within or on a substrate material includes: generating first and second numbers of cavities within or on a substrate material and filling the first and second numbers of cavities with first and second hard magnetic materials, respectively exhibiting first and second coercive field strengths, wherein the second coercive field strength is smaller than the first coercive field strength. The method further includes magnetizing, in a first direction, the first and second arrangements of magnetic structures, by a magnetic field having a field strength that exceeds the first and second coercive field strengths. The method further magnetizes the second arrangement of hard magnetic structures in a second direction, which differs from the first direction, by a second magnetic field having a field strength below the first coercive field strength but greater than the second coercive field strength.

13 Claims, 16 Drawing Sheets

(51) Int. Cl.

| | |
|---|---|
| ***H01F 1/00*** | (2006.01) |
| ***H01F 1/057*** | (2006.01) |
| ***H01F 41/02*** | (2006.01) |
| ***H01F 41/22*** | (2006.01) |

(58) Field of Classification Search
CPC ... H04L 27/04; H04L 27/2697; H04L 7/0075; H04L 25/02; H04B 10/11; H04B 10/116; H04B 10/501; H04B 10/561; H04B 10/60; H01F 7/0273
See application file for complete search history.

(56) References Cited

U.S. PATENT DOCUMENTS

| | | | |
|---|---|---|---|
| 9,221,217 | B2 | 12/2015 | Lisec et al. |
| 10,014,465 | B1 | 7/2018 | Liu et al. |
| 10,202,577 | B2 | 2/2019 | Spuhler et al. |
| 10,854,223 | B2 * | 12/2020 | Lisec ..... G01R 33/06 |
| 11,212,003 | B2 * | 12/2021 | Jungnickel ..... H04L 5/0091 |
| 2007/0195587 | A1 | 8/2007 | Kim et al. |
| 2008/0218299 | A1 | 9/2008 | Arnold |
| 2009/0008922 | A1 | 1/2009 | Schutzmann et al. |
| 2009/0278642 | A1 | 11/2009 | Fullerton et al. |
| 2013/0082105 | A1 | 4/2013 | Schutzmann et al. |
| 2016/0055358 | A1 | 2/2016 | Paul et al. |
| 2016/0093424 | A1 | 3/2016 | Zhu et al. |
| 2018/0053523 | A1 | 2/2018 | Lisec et al. |
| 2018/0102681 | A1 | 4/2018 | Prussmeier |
| 2020/0211747 | A1 | 7/2020 | Heinrich et al. |
| 2020/0282463 | A1 | 9/2020 | Fujikawa et al. |

FOREIGN PATENT DOCUMENTS

| | | | |
|---|---|---|---|
| CN | 107765195 | A | 3/2018 |
| DE | 1564315 | A1 | 9/1969 |
| DE | 3026299 | A1 | 2/1982 |
| DE | 102016215616 | A1 | 2/2018 |
| JP | S54-152200 | A | 11/1979 |
| JP | H06-260339 | A | 9/1994 |
| JP | 2004-063050 | A | 2/2004 |
| JP | 2007-227916 | A | 9/2007 |
| JP | 2009-4069 | A | 1/2009 |
| JP | 2012-529181 | A | 11/2012 |
| JP | 2014-095535 | A | 5/2014 |
| JP | 2018-201018 | A | 12/2018 |
| KR | 2002-0020140 | A | 3/2002 |
| WO | 2015058206 | | 4/2015 |
| WO | 2019/030399 | A1 | 2/2019 |

OTHER PUBLICATIONS

English language translation of Notice of Allowance dated Sep. 20, 2022, issued in application No. CN 202010649585.5 (p. 1 of attachment).
Wang, R.; "Spin transport and magnetization reversal in the vertically oriented magnetic multilayer films;" Apr. 2019; pp. 1-58.
Abstract of "Spin transport and magnetization reversal in the vertically oriented magnetic multilayer films;" (pp. 5-6 of attachment).
Chinese language office action dated Nov. 29, 2021, issued in application No. CN 202010649585.5.
English language translation of office action dated Nov. 29, 2021, issued in application No. CN 202010649585.5.
Wang, X., "Methods for Changing Distribution of Magnetizing Field of Permanent Magnet;" Micro motor; Mar. 2004; pp. 3-6.
English language abstract of "Methods for Changing Distribution of Magnetizing Field of Permanent Magnet".
Japanese language office action dated Nov. 15, 2021, issued in application No. JP 2020-119128.
English language translation of office action dated Nov. 15, 2021, issued in application No. JP 2020-119128.
https://www.sensitec.com/fileadmin/sensitec/Products_and_Solutions/Angle_and_Length/Linear_Scales/SENSITEC_Magnetische_Massstaebe_DE (Mar. 2016).
Petersen et al., "Laser micromachined permanent magnet arrays with spatially alternating magnetic field distribution", Proc. PowerMEMS Conf., Atlanta, GA, USA, 2012.
F. Dumas-Bouchiat et al., "Thermomagnetically patterned micromagnets", Appl. Phys. Lett., 96, 102511 (2010).
R Fujiwara et al., "Micrometer scale magnetization of neodymium magnet for integrated magnetic MEMS", Proc. MEMS Conf., Shanghai, China, 2016.
C. Valez et al., "Simulation and experimental validation of a selective magnetization process for batch-patterning magnetic layers", J. Phys.: Conf. Ser. 660 012006, 2015.
T. Reimer et al., "Temperature-stable NdFeB micromagnets with high-energy density compatible with CMOS back end of line technology", MRS Advances, No. 1, 2016.
https://www.magsys.de/index.php/de/produkte-dienstleistungen/magnetisiervorrichtungen.
https://de.wikipedia.org/wiki/Magnetwerkstoffe.
https://mqitechnology.com/products/bonded-neo-powder/product-comparison-tool/.
https://mqitechnology.com/wp-content/uploads/2017/09/mqp-14-12-20000-070.pdf.
https://mqitechnology.com/wp-content/uploads/2017/09/mqp-14-9-20061-070.pdf.
Japanese language office action dated Nov. 7, 2022, issued in application No. JP 2020-119128.

* cited by examiner

METHOD OF PRODUCING AN OPPOSITELY MAGNETIZED MAGNETIC STRUCTURE

CROSS-REFERENCE TO RELATED APPLICATION

This application claims priority from German Patent Application No. DE 102019210177.1, which was filed on Jul. 10, 2019, and is incorporated herein in its entirety by reference.

The present Invention Report describes a method of oppositely magnetizing microstructures of permanent-magnetic materials on planar substrates. The present application deals with selective magnetization of miniaturized, permanent-magnetic arrangements.

BACKGROUND OF THE INVENTION

Permanent-magnetic arrangements based on structures having different magnetic orientations are of fundamental importance for a multitude of technical devices. There is wide interest in being able to apply the solutions which have established themselves in the field of conventional technology also to microsystems.

A first precondition of this is that hard magnetic structures or microstructures on typical substrates of semiconductor and/or MEMS technology may be produced from silicon and/or glass.

A second precondition is that adjacent magnets or micromagnets may be magnetized in different directions, or may be oppositely magnetized, as desired. Since a substrate may have several hundred or several thousand MEMS components located thereon, each of which may contain several hard magnetic microstructures, serial magnetization as is common in producing conventional magnetic scales, for example, would be too time-consuming.

In addition, the smallest possible period, the so-called pitch, which may be implemented by means of currently available devices, amounts to 0.5 mm. One may assume that both the dimensions of the micromagnets and the distances therebetween may be clearly smaller in many cases of application. There have been several methods of producing magnetic structures or micromagnetic structures, some of which will be listed below.

For example, laser-based material processing has been allowing for a long time already to produce three-dimensional components of complex shapes with high precision. It is quite possible to implement an oppositely magnetized scale with a period of 250 μm by interleaved, individually magnetized combs. Production of the individual combs is effected by means of laser processing of an SmCo film of a thickness of 300 μm.

In addition, e.g., in so-called "thermomagnetic patterning", a homogeneously pre-magnetized layer made of a hard magnetic material is locally heated up by means of laser, through, e.g., a template or mask, and is oppositely magnetized in those areas by means of an opposite magnetic field applied at the same time. In this manner, a checkered pattern consisting of oppositely magnetized squares of a size of 50×50 $\mu m^2$ may be produced, e.g., in an NdFeB layer of a thickness of 4 μm on a Si substrate. Due to the heat conduction within the NdFeB layer itself, or across the substrate, the depth of the oppositely magnetized areas is limited to several micrometers.

In one variant of thermomagnetic patterning, e.g., a thick NdFeB platelet is bonded onto a glass substrate, is sawn down to the glass in a predefined pattern and is thereafter magnetized on its entire surface. Subsequently, individual pixels and/or lines are oppositely magnetized by selective heating using laser. The magnetic field that may be used is provided by the directly adjacent NdFeB structures.

Heating of the pattern is not required. When using a template or mask of a soft magnetic material with high permeability, magnetic patterns may also be produced, within a hard magnetic layer, without heating. The opposite magnetic field that is applied is amplified, within the mask ridges, to such an extent that the areas of the hard magnetic layer which are located underneath are oppositely magnetized. This method is restricted to layers comprising low remanence and coercive field strength.

The above-mentioned variants of thermomagnetic patterning would be best suited for MEMS since the micromagnets thus produced ensure large forces because of the material and the comparatively large volume. Integration into MEMS production processes is unresolved, however. The methods enable only very weak micromagnets unsuitable for MEMS actuators. In addition, integration into MEMS production processes is problematic in these cases, too, if the hard magnetic layers have to be patterned. Conventional laser processing tends to be unsuitable for MEMS because of high cost and/or of the incompatibility in terms of batch processing.

However, a technological method based on the agglomeration of powder by means of atomic layer deposition (ALD) enables producing high-performance magnets or micromagnets on silicon and glass substrates which are compatible with standard processes of MEMS and semiconductor processing. This method will be described hereafter.

Initially, cavities or microcavities are created within the substrate. Subsequently, the microcavities are filled with loose powder, or particles, of sizes in terms of μm. Thereafter, the substrate is exposed to ALD, during which process the initially loose particles within the microcavities are agglomerated to form mechanically firm, porous microstructures. For such structures manufactured, e.g., of NdFeB powder on Si substrates, excellent magnetic properties with high reproducibility have been confirmed. The magnets or micromagnets and/or the magnetic fields of the micromagnets are all aligned in parallel.

SUMMARY

According to an embodiment, a method of producing a magnetic structure within or on a substrate material may have the steps of: producing a first number of cavities within or on the substrate material, and filling the first number of cavities with a first hard magnetic material exhibiting a first coercive field strength so as to generate a first hard magnetic arrangement; producing a second number of cavities within or on the substrate material, and filling the second number of cavities with a second hard magnetic material exhibiting a second coercive field strength, which is smaller than the first coercive field strength, so as to create a second hard magnetic arrangement; magnetizing the first and second hard magnetic arrangements in a first direction by means of a first magnetic field exhibiting a field strength which exceeds the first and second coercive field strengths; magnetizing the second hard magnetic arrangement in a second direction different from the first direction by means of a second magnetic field exhibiting a field strength which falls below the first coercive field strength but exceeds the second coercive field strength; wherein said magnetization of the second hard magnetic arrangement includes exposing the first and second hard magnetic arrangements to the second magnetic field.

Another embodiment may have a magnetic structure within or on a substrate material including a plurality of hard magnetic arrangements, wherein a first hard magnetic arrangement includes a first number of hard magnetic structures, the structures each including a first hard magnetic material exhibiting a first coercive field strength, wherein a second hard magnetic arrangement includes a second number of hard magnetic structures, the structures each including a second hard magnetic material exhibiting a second coercive field strength, and wherein the first and second hard magnetic arrangements are magnetized in different directions.

Yet another embodiment may have a 3D magnetic structure, which may have a first hard magnetic arrangement within or on a first substrate material including a first number of hard magnetic structures, each of which includes a first hard magnetic material exhibiting a first coercive field strength, and which may have a second hard magnetic arrangement within or on a second substrate material including a second number of hard magnetic structures, each of which includes a second hard magnetic material exhibiting a second coercive field strength, wherein the first and second hard magnetic arrangements are magnetized in different directions, and wherein the first and second substrate materials are firmly connected to each other.

Yet another embodiment may have a 3D magnetic structure, which may have first and second hard magnetic arrangements within or on a first substrate material including first and second numbers of hard magnetic structures, respectively, and which may have first and second hard magnetic arrangements within or on a second substrate material including first and second numbers of hard magnetic structures, respectively, the first number of hard magnetic structures including a first hard magnetic material exhibiting a first coercive field strength, the second number of hard magnetic structures including a second hard magnetic material exhibiting a second coercive field strength, wherein the first and second hard magnetic arrangements are magnetized in different directions, and wherein the first and second substrate materials are firmly connected to each other.

A core idea of the present method (see claim 1) consists in having found that it is possible to produce magnetic structures having oppositely magnetized arrangements of hard magnetic structures within or on a substrate material by means of the following steps.

1. A first number of cavities are produced within or on a substrate material and are filled with a first hard magnetic material exhibiting a first coercive field strength so as to produce a first arrangement of hard magnetic structures.
2. A second number of cavities are produced within or on a substrate material and are filled with a second hard magnetic material exhibiting a second coercive field strength, which is smaller than the first coercive field strength, so as to produce a second arrangement of hard magnetic structures.
3. The first and second arrangements of hard magnetic structures are magnetized, in a first direction, by a first magnetic field having a field strength exceeding the first and second coercive field strengths.
4. The second arrangement of hard magnetic structures is magnetized, in a second direction different from the first direction, by a second magnetic field having a field strength falling below the first coercive field strength but exceeding the second coercive field strength. Magnetizing the second arrangement of hard magnetic structures includes exposing the first and second arrangements of hard magnetic structures to the second magnetic field.

The order of the steps described in 1. and 2. is flexible as a function of the commonly used production conditions of semiconductor and MEMS technology.

As an alternative to steps 1. and 2., e.g., the first and second numbers of cavities may be produced, within or on a substrate material, in parallel or one after the other, and the first and second cavities produced may be filled with the first and second hard magnetic materials, respectively, in parallel or one after the other.

Hard magnetic microstructures or arrangements of hard magnetic structures produced within or on a substrate may be magnetized in one step at the substrate level by means of, e.g., a suitable magnetization device. In this process, the magnets or micromagnets are oppositely magnetized, e.g., in an alternating manner. Magnetizing systems which are able to produce fields of several thousand kA/m across an area of a diameter of 300 mm are available.

Arrangements of hard magnetic structures or microstructures of different hard magnetic materials also enable opposite magnetization.

Initially, arrangements of hard magnetic structures (or microstructures) are produced from a first hard magnetic material A having the coercive field strength $H_{CA}$.

On other areas of the substrate, arrangements of hard magnetic structures or microstructures are thereafter produced, in this manner, from a second hard magnetic material B having the coercive field strength $H_{CB}$. $H_{CB}$ is smaller than $H_{CA}$.

Subsequently, the arrangements of hard magnetic structures or microstructures of both types are magnetized in parallel by a magnetic field of the strength $H_1$, which exceeds $H_{CA}$ and $H_{CB}$, within one step.

Finally, the arrangements of hard magnetic structures or microstructures of the material B are re-magnetized by applying an opposite magnetic field of the strength $H_2$, which is larger than $H_{CB}$ but smaller than $H_{CA}$, in one step. The original magnetizations of the arrangements of hard magnetic structures or microstructures of the material A are maintained in the process.

Mass production of the oppositely magnetized arrangements of hard magnetic structures or microstructures is facilitated by accelerating the process. Magnetization of a hard magnetic material is performed in one step. In addition, utilizing several materials enables different magnetizations of the materials on the basis of the different coercive field strengths of the materials.

Typical dimensions of the arrangements of hard magnetic structures are as follows:

Edge lengths of the structures/magnets: 10-1000 μm and/or

Distances between the structures/magnets: 10-1000 μm

Advantageous dimensions of the arrangements of hard magnetic structures are as follows:

Edge lengths of the structures/magnets: 20-500 μm and/or

Distances between the structures/magnets: 20-500 μm.

Opposite magnetizability of integrated arrangements of hard magnetic structures or microstructures are of interest, e.g., for Miniaturized magnetic scales, MEMS components based on voice coil drives or Halbach arrays, MEMS components with moveable arrangements, supported in a contact-free manner, of hard magnetic structures or microstructures on the basis of magnetic levitation.

In accordance with embodiments (see claim 2) the method is one wherein the difference between the first and second coercive field strengths is more than 50%.

Since modern magnetizing devices enable setting and/or reproducing a magnetic field within an accuracy of a few percent, a difference in the coercive field strength of more than 50% between the materials is sufficient for implementing oppositely magnetized arrangements of hard magnetic structures or microstructures.

In accordance with embodiments (see claim 3), the method at hand is a method wherein the depths and/or the cross-sections of the first number of cavities for the first arrangement of hard magnetic structures differ from the depths and/or the cross-sections of the second number of cavities for the second arrangement of hard magnetic structures, so that the magnetic field strengths of the individual magnets within the first and second arrangements following magnetization are identical.

In other words, the method is one wherein the depths and/or the cross-sections of the magnets of the first arrangements differ from the depths and/or the cross-sections of the magnets of the second arrangement, so that the magnetic field strengths of the individual magnets following magnetization are identical.

Since the magnets or micromagnets consist of an arrangement made of two different magnetic materials having different properties, magnets or structures having identical dimensions will indeed result in fields having opposite signs but different strengths. This effect may be compensated for via the dimensions of the magnets or micromagnets of both kinds. Accordingly, the field generated by micromagnets made of different materials may be adapted in that, during their production, less deep cavities are etched into the substrate for the magnets or structures made of the first material than for the magnets or structures made of the second material.

In accordance with embodiments (see claim 4), the method is one wherein the cross-sections of the first and second numbers of cavities are identical and the depths of the first and second numbers of the cavities differ from each other, so that the magnetic field strengths of the individual magnets within the first and second arrangements of hard magnetic structures following magnetization are identical.

In other words, the method is one wherein the cross-sections of the magnets of the first and second arrangements of hard magnetic structures are identical and the depths of the magnets of the first and second arrangements of hard magnetic structures differ from each other, so that the magnetic field strengths of the individual magnets following magnetization are identical.

A specific advantage of this embodiment is that the cross-section of all magnets or micromagnets may stay the same. This may be significant, e.g., for magnetic scales.

In accordance with embodiments (see claim 5), the method is one wherein filling of the first and second numbers of cavities comprises physical and/or chemical solidification of the material filled in, e.g., by exposing the substrate material to atomic layer deposition.

The initially loose hard magnetic particles and/or powders are agglomerated, within the cavities or microcavities, to form mechanically firm, porous structures or microstructures.

In accordance with embodiments (see claim 6), the method is one wherein the substrate material is glass material, silicon material, plastic material or ceramic material.

Using common substrate materials such as glass, silicon, plastic or ceramic, for example, facilitates applying the inventive method in the usual production conditions of semiconductor and MEMS technology.

In accordance with embodiments (see claim 7), the method is one wherein the first and second hard magnetic materials are NdFeB material and/or SmCo material and/or PtCo material.

Using common hard magnetic materials such as NdFeB and/or SmCo and/or PtCo, for example, facilitates applying the inventive method in the usual production conditions of semiconductor and MEMS technology.

In accordance with embodiments (see claim 8), the method is one wherein the first and second hard magnetic materials are formed of powdery material and/or material particles.

Powdery materials and/or particles enable filling the cavities with different cross-sections and/or depths.

In accordance with embodiments (see claim 9), the method is one wherein producing the arrangements of hard magnetic structures within or on the substrate includes the following steps.

1. A first arrangement of hard magnetic structures is produced within or on a first substrate.
2. A second arrangement of hard magnetic structures is produced within or on a second substrate.

The first and second substrates are connected prior to magnetization.

The substrates each contain magnets or micromagnets made of one material only and are firmly connected to each other, prior to magnetization, via bonding at the substrate level. The silicon technology has a number of established bonding processes available to it which are based, e.g., on printed glass frit, or galvanically deposited Au—Sn stacks for hermetic connection, or, while using patterned adhesives and polymers, for non-hermetic connections.

By stacking substrates, three-dimensional arrangements of hard magnetic microstructures are also possible. Since the geometries and positioning of the magnets or micromagnets within the corresponding substrate may vary as desired, it is possible to produce arrangements of mutually repelling magnets or micromagnets in this manner.

In accordance with embodiments (see claim 10), the method is one wherein producing the arrangements of hard magnetic structures within or on the substrate includes the following steps.

1. A first number of first and second hard magnetic structures is produced within or on a first substrate.
2. A second number of first and second hard magnetic structures is produced within or on a second substrate.

The first and second substrates are connected prior to magnetization.

Since the geometries and positioning of the individual magnets or micromagnets on any of the substrates may vary as desired, it is possible to produce arrangements of mutually repelling micromagnets in this manner.

In addition, using first and second hard magnetic structures within the first and/or second substrate(s) enables producing a multitude of three-dimensional arrangements of hard magnetic microstructures.

In accordance with embodiments (see claim 11), the method is one wherein the individual magnets of the first and second arrangements of hard magnetic structures are alternately arranged within or on a substrate material.

In accordance with embodiments (see claim 12), the method is one wherein the first and/or the second arrangement(s) of hard magnetic structures is/are located either on a first surface of the substrate material or extend(s) from a first surface of the substrate material as far as a predetermined depth of the substrate material or as far as a second surface located opposite the first surface. The first and/or second arrangement(s) of hard magnetic structures may have any depth, depending on the application, and may even extend as far as the second surface of the substrate material.

By using a continuous structure, one achieves a particularly high magnetic field strength thanks to a higher (maximum) aspect ratio, see also FIG. 6. As of a specific value, e.g., 7:1, however, the magnetic field generated will exhibit only a slight increase. In accordance with embodiments, what is at hand are the 2D and/or 3D magnetic structures produced by means of an inventive method described herein.

BRIEF DESCRIPTION OF THE DRAWINGS

Embodiments of the present invention will be detailed subsequently referring to the appended drawings, in which:

FIG. 2*a* is the first in a series of schematic representations that illustrate the filling of the cavities or microcavities, wherein FIG. 2*a* illustrates empty cavities;

FIG. 2*b* is the second in a series of schematic representations that illustrate the filling of the cavities or microcavities, wherein FIG. 2*b* illustrates loose particles in the cavities;

FIG. 2*c* is the third in a series of schematic representations that illustrate the filling of the cavities or microcavities, wherein FIG. 2*c* illustrates solidified particles in the cavities;

DETAILED DESCRIPTION OF THE INVENTION

Specifically, there are a multitude of possibilities of implementing the inventive methods and of developing them further. To this end, reference shall be made to the claims, on the one hand, and to the following description of embodiments in connection with the drawings, on the other hand.

Figure 1A:
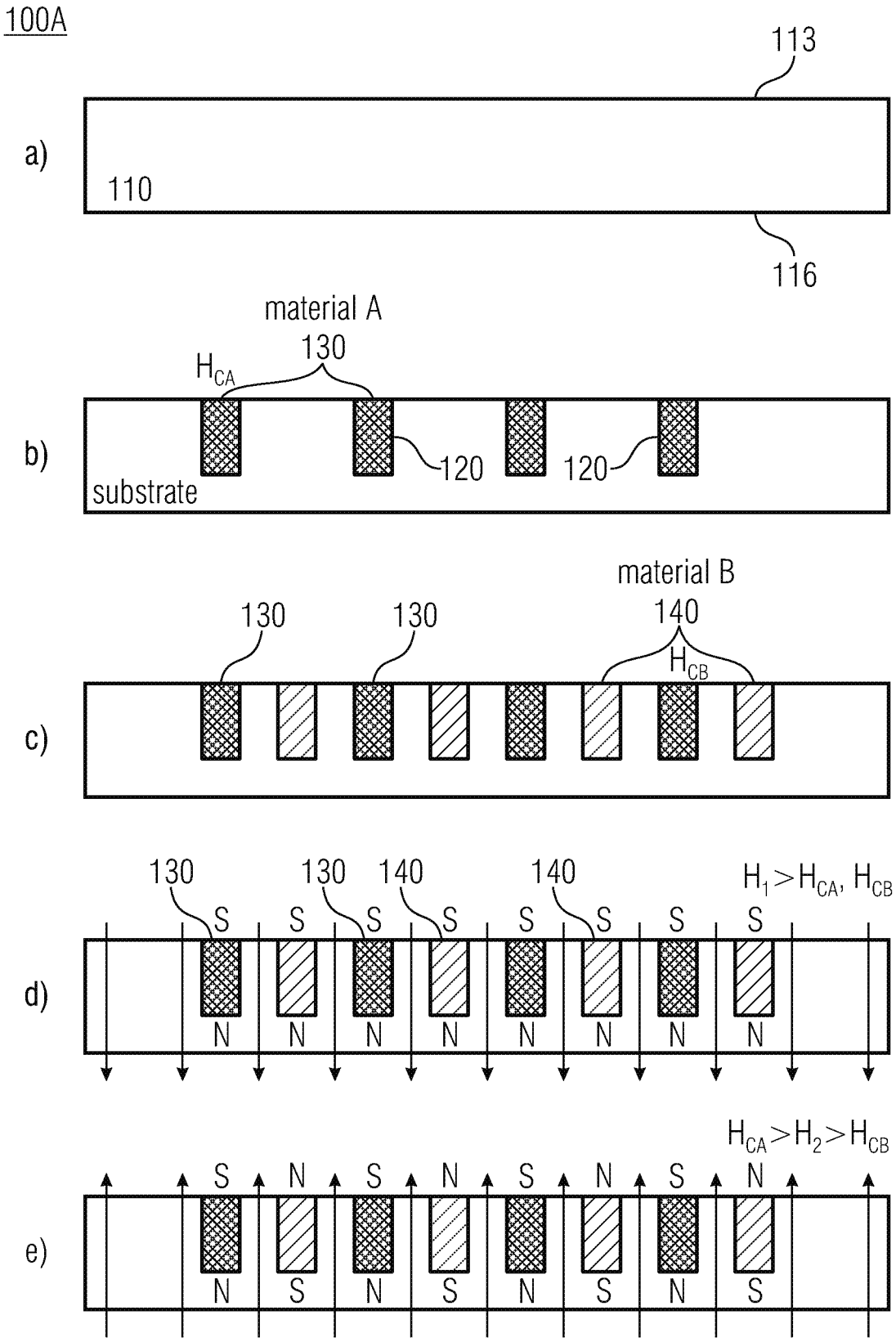
FIG. 1A shows a schematic representation of the method of producing an oppositely magnetized microstructure.

FIG. 1A shows a schematic representation of the inventive method 100A of producing a magnetic structure comprising oppositely magnetized arrangements of hard magnetic structures. The steps of the method are shown in FIG. 1A a) to FIG. 1A e).

FIG. 1A a) shows a planar substrate material 110, the starting point of the method, comprising a first surface 113 and a second surface 116 located opposite the first surface 113. It is readily possible for the substrate material to contain silicon and/or glass material and/or plastic and/or ceramic.

In FIG. 1A b), a first number of cavities 120 are produced and filled with a first hard magnetic material 130 exhibiting a first coercive field strength $H_{CA}$ so as to produce a first arrangement of hard magnetic structures. Filling of the cavities is explained in more detail in FIG. 2.

In FIG. 1A c), a second number of cavities 120 are produced and filled with a second hard magnetic material 140 exhibiting a second coercive field strength $H_{CB}$ so as to produce a second arrangement of hard magnetic structures. The first coercive field strength $H_C$A is ideally more than 50% higher than the second coercive field strength $H_C$.

In FIG. 1A d), the first and second arrangements of hard magnetic structures made of first and second materials 130, 140 are magnetized, in a first direction, by a magnetic field exhibiting a field strength $H_1$, which exceeds the first and second coercive field strengths $H_{CA}$, $H_{CB}$.

In FIG. 1A e), only the second arrangement of hard magnetic structures is magnetized in an opposite direction by a magnetic field exhibiting a field strength $H_2$, which falls below the first coercive field strength $H_{CA}$ but exceeds the second coercive field strength $H_{CB}$, said magnetization of the second arrangement of hard magnetic structures including exposure of the first and second arrangements of hard magnetic structures to the second magnetic field.

Figure 1B:
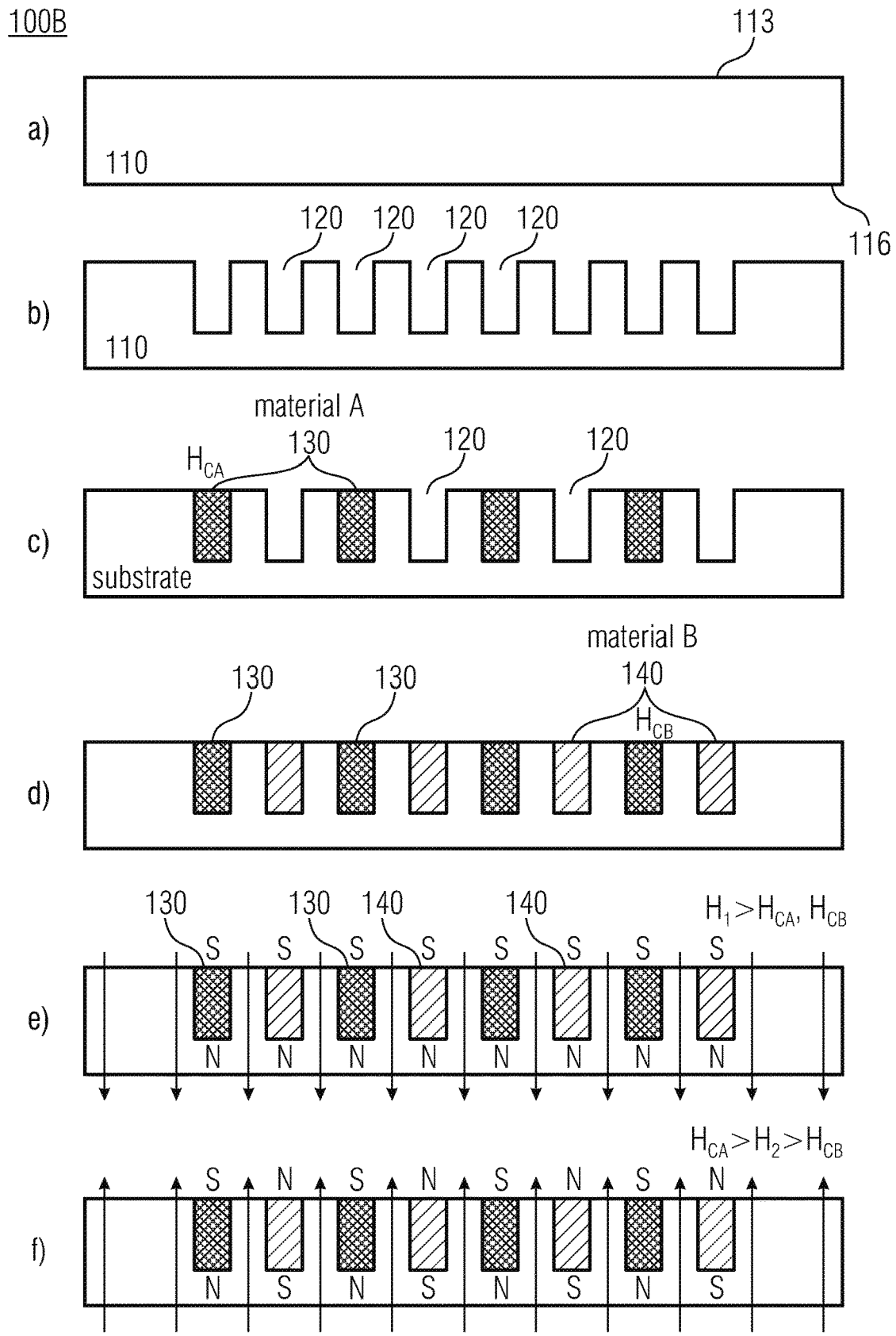
FIG. 1B shows a schematic representation of the alternative method of producing an oppositely magnetized microstructure.

FIG. 1B shows a schematic representation of an alternative method 100B of producing a magnetic structure having oppositely magnetized arrangements of hard magnetic structures. The steps of the method are shown in FIG. 1B a) to FIG. 1B f).

FIG. 1B a) shows a planar substrate material 110, the starting point of the method, comprising a first surface 113 and a second surface 116 located opposite the first surface 113. It is readily possible for the substrate material to contain silicon and/or glass material and/or plastic and/or ceramic.

FIG. 1B b) shows the first step of the method 100B, wherein a plurality of cavities 120 are produced within the substrate 110. The cavities 120 extend from the first surface 113 toward the second surface 116.

In FIG. 1B c), a first number of cavities 120 is filled with a first hard magnetic material 130 exhibiting a first coercive field strength $H_{CA}$ so as to produce a first arrangement of hard magnetic structures. Filling of the cavities is explained in more detail in FIG. 2.

In FIG. 1B d), a second number of cavities 120 are filled with a second hard magnetic material 140 exhibiting a second coercive field strength $H_{CB}$ so as to produce a second arrangement of hard magnetic structures. The first coercive field strength $H_{CA}$ is ideally more than 50% higher than the second coercive field strength $H_{CB}$.

In FIG. 1B e), the first and second arrangements of hard magnetic structures made of first and second materials 130, 140 are magnetized, in a first direction, by a magnetic field exhibiting a field strength $H_1$, which exceeds the first and second coercive field strengths $H_{CA}$, $H_{CB}$.

In FIG. 1B f), only the second arrangement of hard magnetic structures is magnetized in an opposite direction by a magnetic field exhibiting a field strength $H_2$, which falls below the first coercive field strength $H_{CA}$ but exceeds the second coercive field strength $H_{CB}$, said magnetization of the second arrangement of hard magnetic structures including exposure of the first and second arrangements of hard magnetic structures to the second magnetic field.

In other words, FIG. 1A and FIG. 1B describe production of a magnetic structure consisting of oppositely magnetized arrangements of hard magnetic structures within or on one and the same substrate, on the basis of using two different magnetic materials 130, 140.

Using arrangements of hard magnetic structures or microstructures made of different hard magnetic materials facilitates opposite magnetization.

Initially, hard magnetic structures or microstructures are produced from a first hard magnetic material 130 having the coercive field strength $H_{CA}$.

Subsequently, hard magnetic structures or microstructures made of a second hard magnetic material 140 exhibiting the coercive field strength $H_{CB}$ are produced, in the same manner, on other areas of the substrate 110. $H_{CB}$ is smaller than $H_{CA}$.

Subsequently, the hard magnetic structures or microstructures of both types are magnetized in parallel in one step by a magnetic field of the strength $H_1$, which exceeds $H_{CA}$ and $H_{CB}$.

Figure 3:
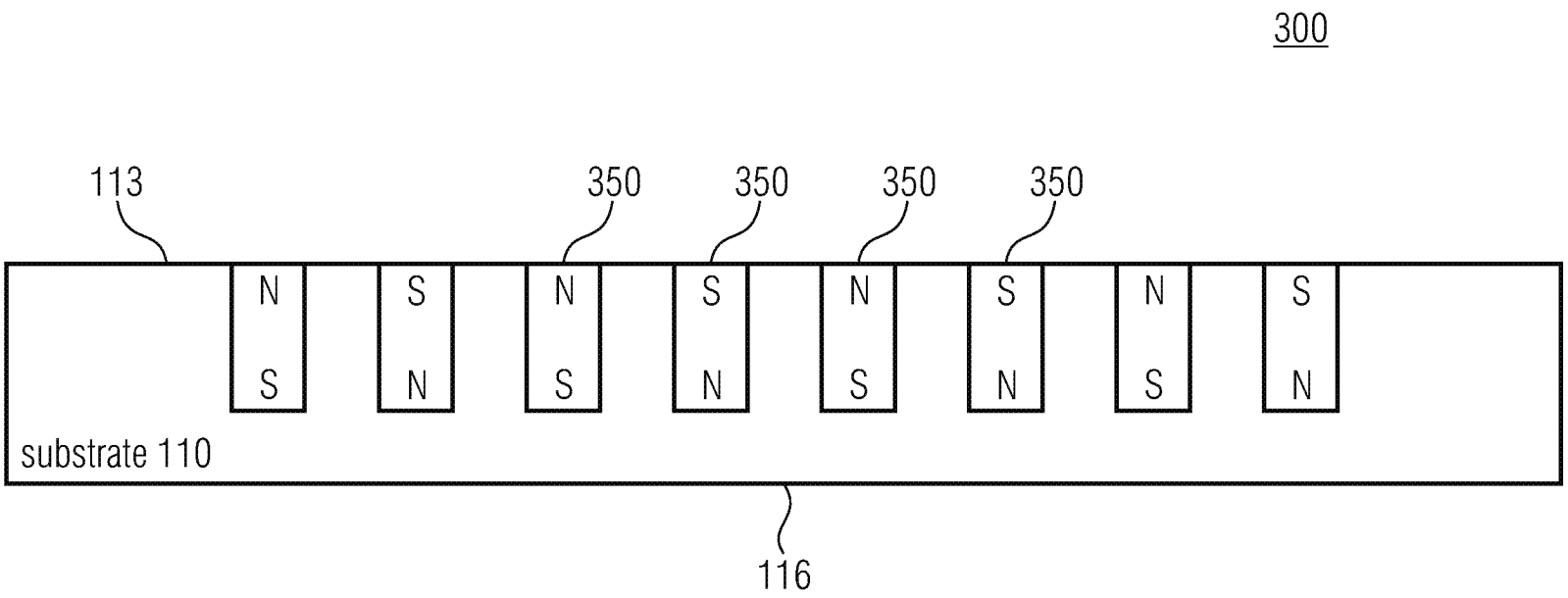
FIG. 3 shows a schematic representation of a permanent-magnetic magnetic structure with oppositely magnetized arrangements of hard magnetic structures.

Finally, the hard magnetic structures or microstructures of the material 140 are remagnetized in one step by applying an opposite magnetic field of the strength $H_2$, which is larger than $H_{CB}$ but smaller than $H_{CA}$. The original magnetization of the hard magnetic structures or microstructures made of the material 130 is maintained in the process. A result of the method 100A and/or 100B is depicted in FIG. 3 or in FIG. 7.

In FIG. 2, filling 200 of the cavities 120, shown in FIG. 1A b), c) and FIG. 1B c), d), respectively, is explained in more detail.

In FIG. 2 *a*) to FIG. 2 *c*), production of solidified porous hard magnetic structures or microstructures 240 on a substrate by agglomerating loose particles 230 by means of ALD is schematically depicted step by step.

Figure 2A:
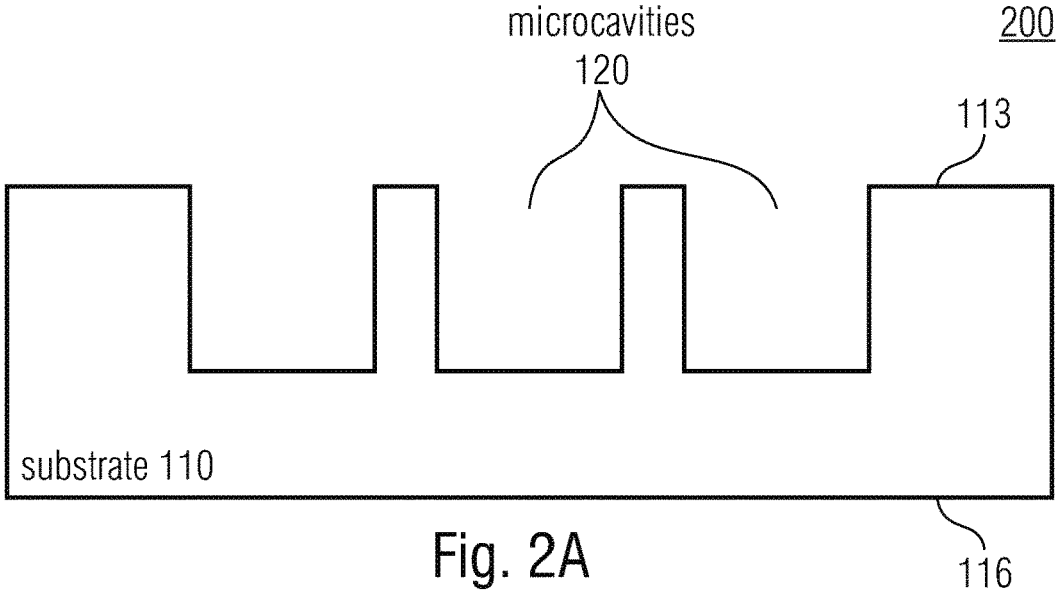

FIG. 2*a* is similar to FIG. 1B b) and shows a planar substrate material 110 comprising first and second surfaces 113, 116 and cavities 120 extending from the first surface 113 of the substrate material toward a second surface 116 located opposite the first surface.

Figure 2B:
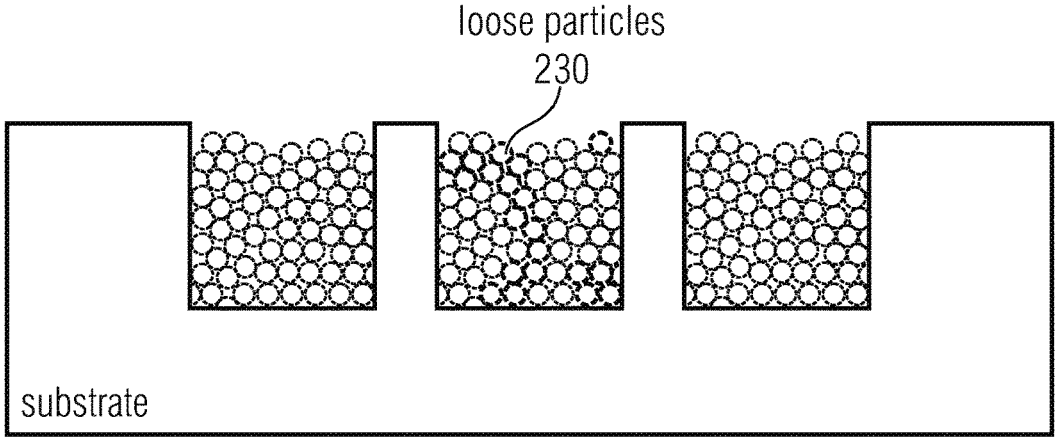

In FIG. 2*b*, the cavities 120 are filled with loose particles 230 and/or material powder of hard magnetic materials, such as NdFeB, SmCo and/or PtCo materials.

Figure 2C:
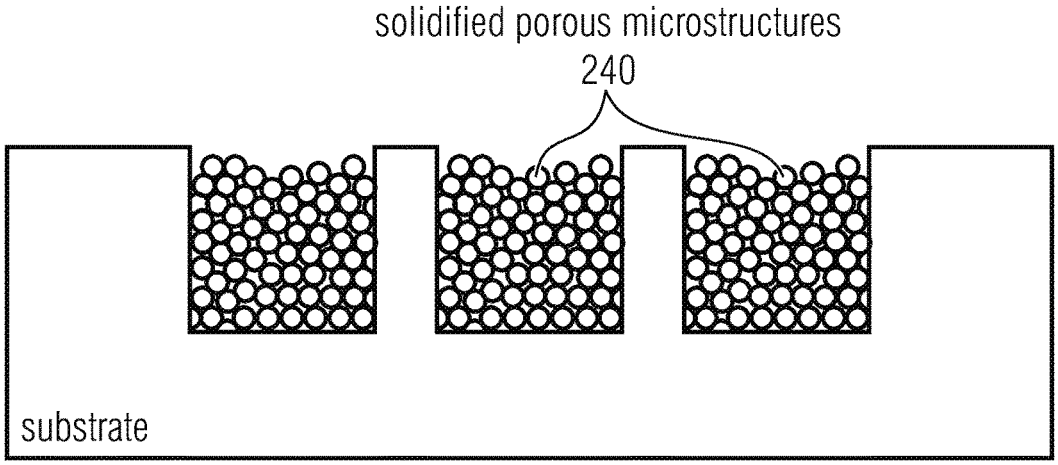

In FIG. 2*c*, the loose particles 230 are solidified, or agglomerated, by means of physical and/or chemical solidification, e.g., by means of ALD. The solidified porous structures 240 are thus prepared for magnetization, described in FIG. 1A d), e) and in FIG. 1B e), f), respectively.

The cavities produced in FIG. 1B b) and having different depths and/or cross-sections may simply be filled with loose, powdery materials. The powdery materials are solidified within the cavities and are thus prepared for magnetization, described in FIG. 1A d), e) and in FIG. 1B e), f), respectively.

FIG. 3 shows a schematic representation of a magnetic structure 300 comprising a planar substrate 110 having hard magnetic structures 350 of equal size. The hard magnetic structures 350 are oppositely magnetized and extend from the first surface 113 toward the second surface 116.

In other words, FIG. 3 is schematic representation of permanent-magnetic microstructures or hard magnetic structures 350 with opposite magnetization, integrated on a planar substrate 110. These permanent-magnetic microstructures or hard magnetic structures 350, or the magnetic structure 300, may be used, e.g., within a rotating MEMS element and/or for magnetic contact-free support and may be produced, e.g., by the method 100A in FIG. 1A.

Figure 5:
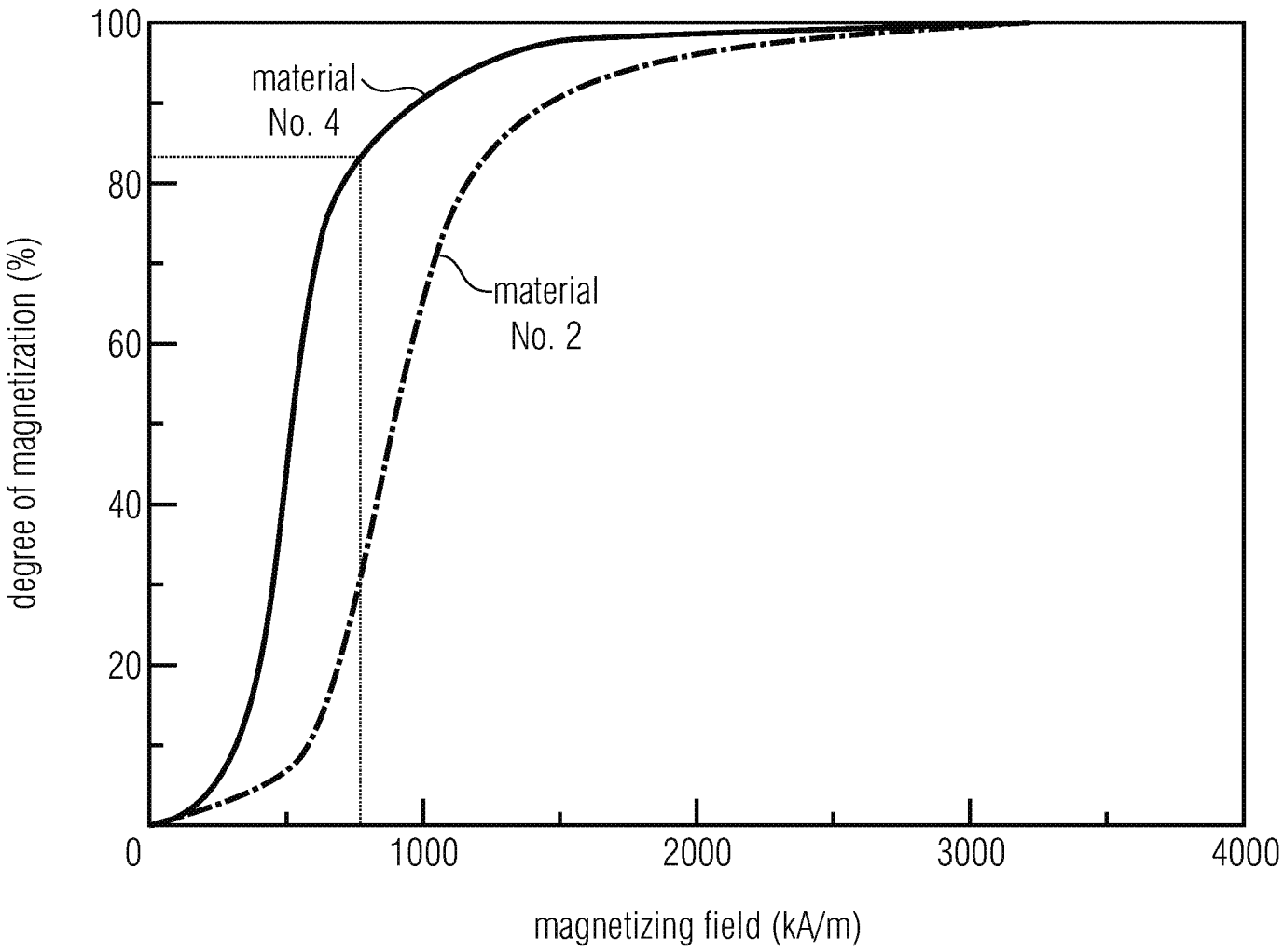
FIG. 5 shows a diagram of the degree of magnetization of materials No. 2 and No. 4 in Table 1 as a function of the magnetic field used for magnetization.

Since the magnets or micromagnets consist of a magnetic structure having arrangements of hard magnetic structures made of two different magnetic materials exhibiting different properties, and since magnetization of the magnets or micromagnets made of the second hard magnetic material 140 is incomplete, see FIG. 5, hard magnetic structures having identical dimensions will indeed generate fields having opposite signs but different strengths. This effect may be compensated for, e.g., via the dimensions of the magnets or micromagnets of both types.

Figure 4:
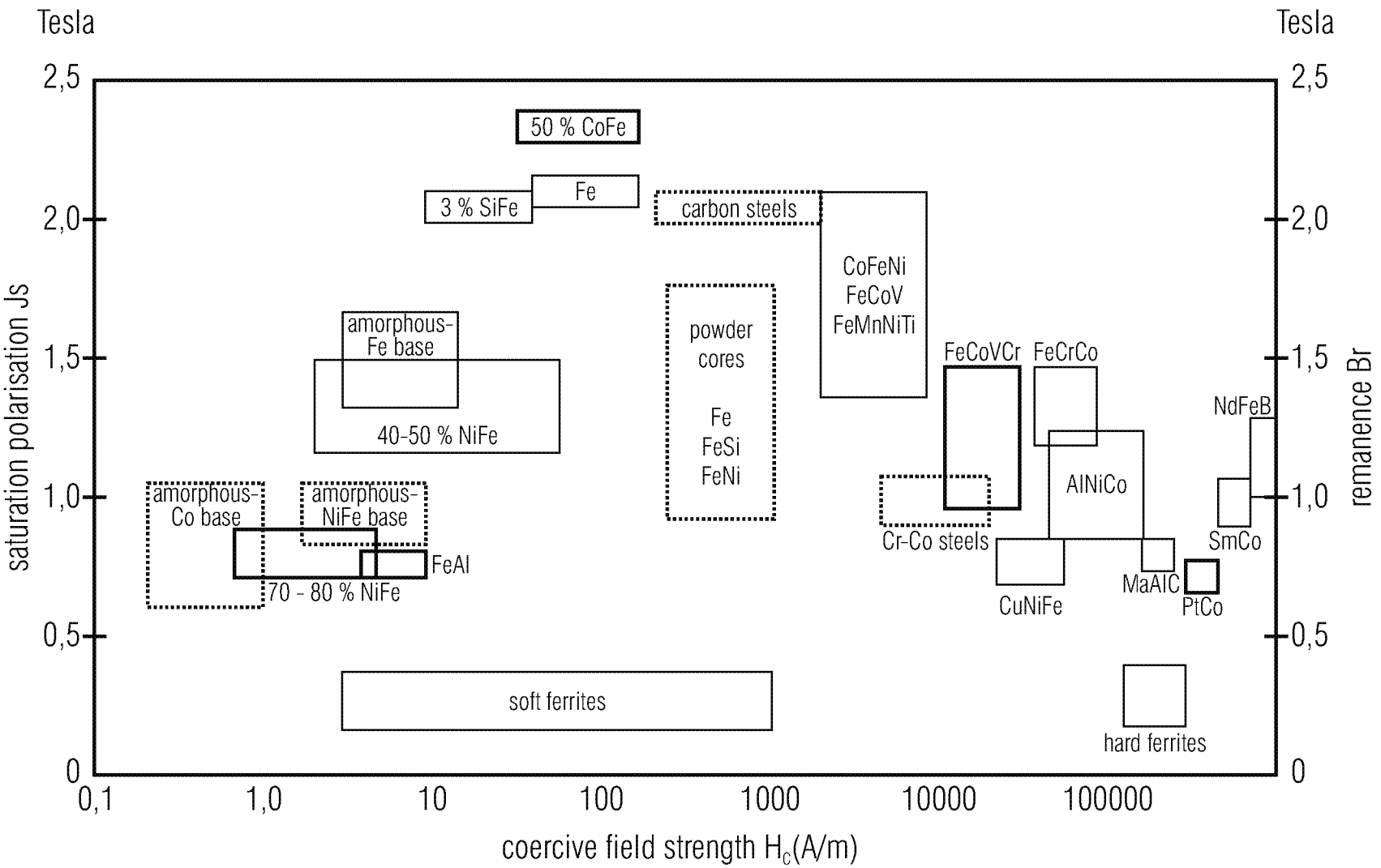
FIG. 4 shows a diagram of the respective remanence and coercive field strength of the most important magnetic materials.

FIG. 4 shows an overview of the respective remanence and coercive field strength of the most important magnetic materials that may be used, e.g., in the method 100A in FIG. 1A. In accordance with FIG. 4, the coercive field strengths He of the most common hard magnetic materials such as NdFeB, SmCo and/or PtCo, for example, differ from one another by factors.

TABLE 1

Remanence, Coercive Field Strength and Curie Temperature of Several NdFeB Powders by Magnequench [10].

| No. | Designation of Material | Remanence $B_r$ (mT) | Coercive Field Strength $H_C$ (kA/m) | Curie Temperature $T_C$ (° C.) |
|---|---|---|---|---|
| 1 | MQP-A-10179 | 780-820 | 1030-1350 | 305 |
| 2 | MQP-14-12-20000 | 850-860 | 950-1030 | 300 |
| 3 | MQP-14-9-20061 | 835-865 | 690-770 | 302 |
| 4 | MQP-12-5-20092 | 840-870 | 420-480 | 272 |

The coercive field strength $H_C$ may vary strongly even for one and the same material. Table 1 shows, by way of example, the properties of different NdFeB-based powders by one suppler ("Magnequench") of the starting materials for producing permanent magnets. However, it is also to be taken into account that complete magnetization, e.g., in the method 100A in FIG. 1A, involves a magnetic field which by far exceeds the coercive field strength $H_C$ of the corresponding material.

FIG. 5 shows a diagram on the degree of magnetization of materials No. 2 and No. 4 in Table 1 as a function of a magnetic field that may be used for magnetization, e.g., in the method 100A in FIG. 1A, in accordance with the supplier's data sheet. The dotted lines in the diagram illustrate the degree of magnetization of material No. 4 across a field of 800 kA/m.

In other words, FIG. 5 presents a diagram on the degree of magnetization as a function of the applied magnetic field in accordance with a data sheet of the manufacturer.

When it is assumed that for parallel magnetization of an arrangement of oppositely magnetized magnets or micromagnets in accordance with FIG. 1B e), materials No. 2 and No. 4 of Table 1 are used, a field of 2500 kA/m would be sufficient for almost completely magnetizing the magnets or micromagnets of both types.

If, subsequently, a reverse field of 800 kA/m in accordance with FIG. 1B f) is applied, the micromagnets made of material No. 4 will be oppositely magnetized to a degree of more than 80%. The magnets or micromagnets of material No. 2, however, will hardly be influenced since their coercive field strength He of at least 950 kA/m is clearly above the field applied. In this manner it is possible to obtain, by means of the method of FIG. 1A or FIG. 1B, a magnetic structure comprising arrangements of hard magnetic structures, e.g., in accordance with FIG. 3.

Figure 6:
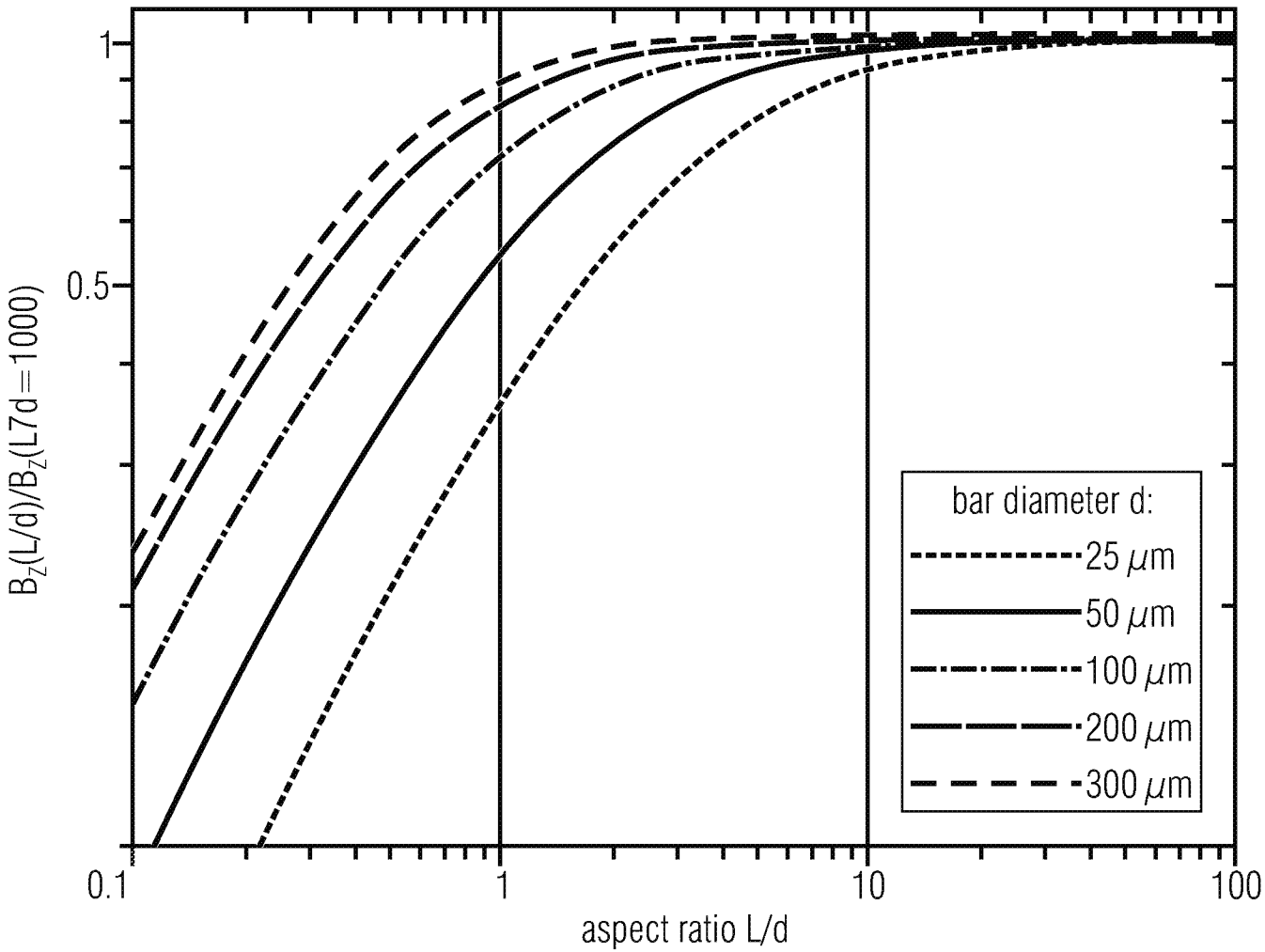
FIG. 6 shows a diagram of the normalized axial magnetic flow density $B_z$ of a bar magnet as a function of the ratio of its length L to its diameter d for various diameters d.

FIG. 6 depicts a diagram on the normalized axial magnetic flux density $B_z$ at a distance of 100 μm above the front end of a bar magnet as a function of the ratio of its length L to its diameter d for different diameters d of between 25 and 400 μm.

In other words, FIG. 6 presents a diagram on the dependence of the magnetic flux density on the aspect ratio of a magnet.

Since the magnets or micromagnets consist of a magnetic structure having arrangements of hard magnetic structures in accordance with FIG. 1B f) that are made of two different magnetic materials exhibiting different properties, hard magnetic structures having identical dimensions will indeed generate fields having opposite signs but different strengths.

Since the coercive field strength He generally does not depend on the dimensions or on the porosity of the magnets or micromagnets but depends only on the material used, this effect may be compensated for, e.g., via the dimensions of the magnets or micromagnets of both types.

The approach, described in FIG. 1A or 1B, to producing magnetic structures having arrangements of oppositely magnetized structures or microstructures, wherein the structures or cavities of different arrangements have specific mutual aspect ratios, may therefore be considered as being feasible, in principle.

Figure 7:
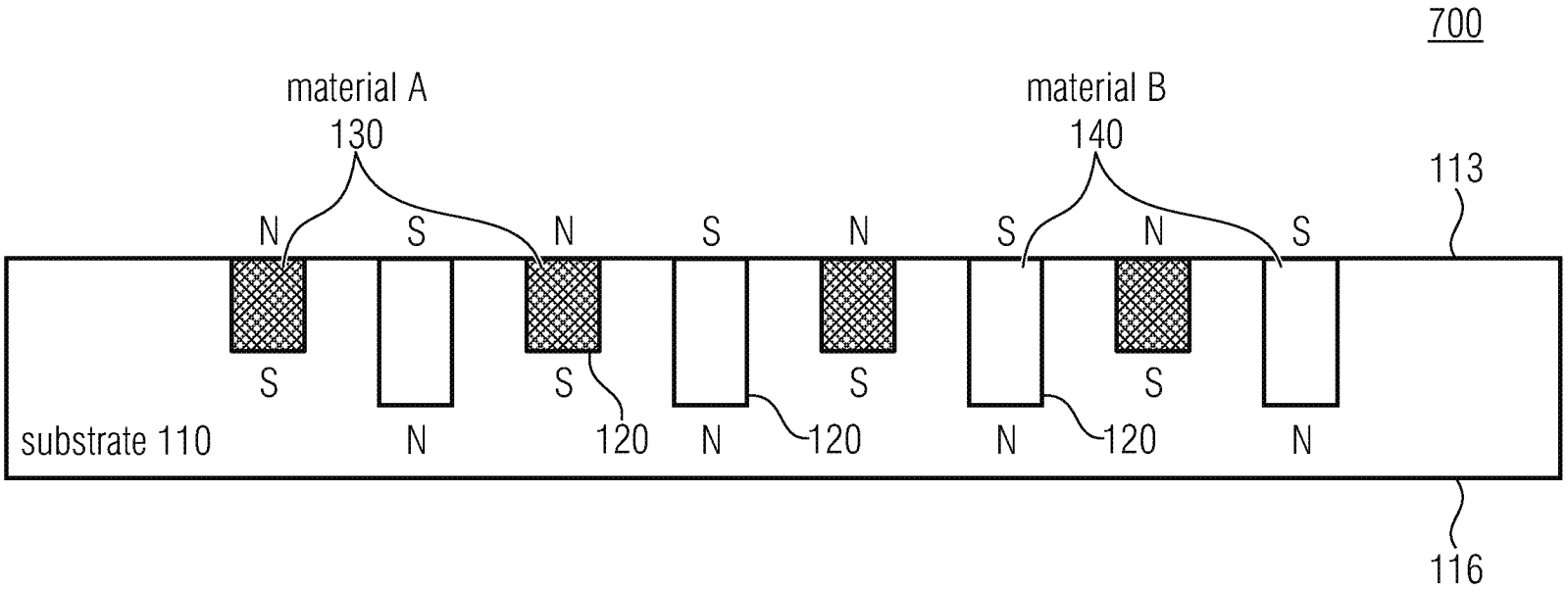
FIG. 7 shows a schematic representation of a permanent-magnetic magnetic structure comprising oppositely magnetized arrangements which comprise magnets or structures of different depths and having magnetic fields of equal strength.

FIG. 7 shows a schematic representation of a magnetic structure 700 which comprises a planar substrate material 110 comprising cavities 120.

The cavities extend from the first surface 113 of the substrate material toward a second surface 116 located opposite the first surface.

A first number of cavities having a first depth are filled with a first material 130 so as to produce a first arrangement of hard magnetic structures. A second number of cavities having a second depth are filled with a second material 140 so as to produce a second arrangement of hard magnetic structures. The alternatingly arranged structures of the first and second arrangements of hard magnetic structures made of the first and second hard magnetic materials 130, 140 are oppositely magnetized.

In other words, two-dimensional arrangements of hard magnetic structures comprising magnetic fields of equal strengths may be produced from hard magnetic structures or microstructures having opposite magnetization within or on planar substrates, e.g., made of silicon and/or glass and/or plastic and/or ceramic.

FIG. 7 presents, e.g., utilization of cavities with different depths for producing magnetic structures comprising arrangements of oppositely magnetized magnets or micromagnets, which generate opposite magnetic fields of equal strength.

The method 100A in FIG. 1A and 100B in FIG. 1B, respectively, are improved by magnetic-field strength compensation between the microstructures. Since two different magnetic materials having different properties generate different magnetic field strengths, this effect is compensated for via the dimensions of the magnets or micromagnets of both types.

Figure 8:
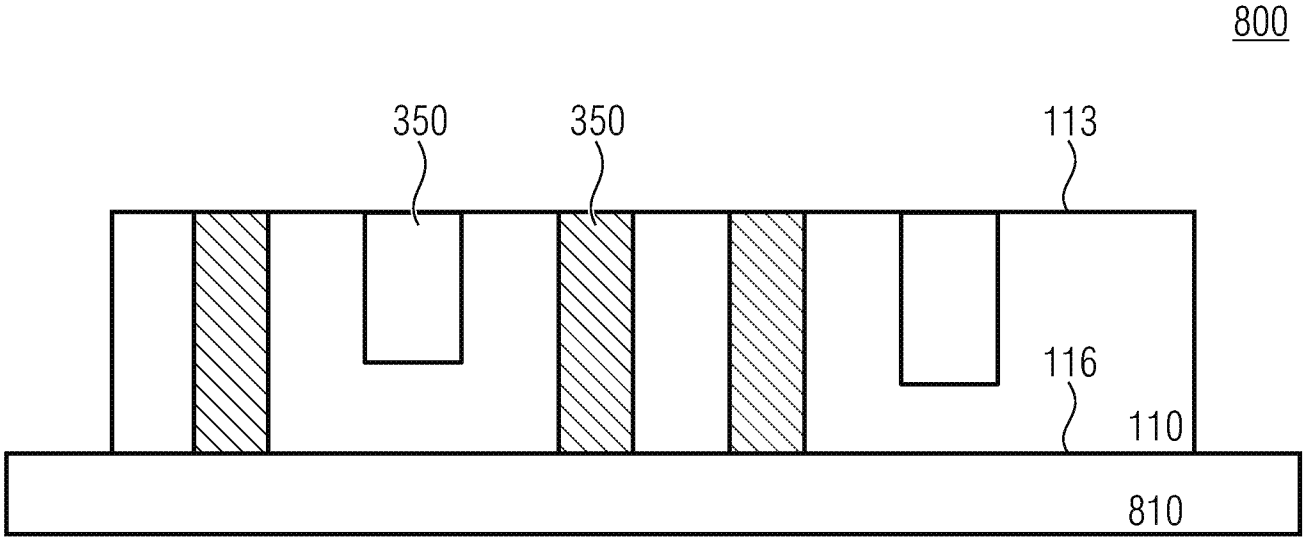
FIG. 8 shows a schematic representation of a permanent-magnetic magnetic structure comprising oppositely magnetized arrangements of different depths which comprise magnets having magnetic fields of equal strengths, the magnets of the first and/or second arrangement(s) extending from a first surface as far as a second surface of the substrate material.

FIG. 8 shows a schematic representation of a magnetic structure 800 which comprises a planar substrate material 110 on a plate 800 comprising arrangements of hard magnetic structures 350. The hard magnetic structures 350 extend from the first surface 113 of the substrate material toward a second surface 116 located opposite the first surface.

The first and/or second arrangements of hard magnetic structures extend at random from the first surface as far as a predetermined depth of the substrate material or even as far as the plate 810 and/or the second surface 116 of the substrate material.

Instead of a plate 810, the surface 116 may be covered with a thin layer on which etching of the continuous cavities stops. In this case, the plate 810 would be integrated on the substrate.

Alternatively, a continuous hard magnetic structure may be produced by performing the steps of FIG. 2 one after the other on both sides 113 and 116 of the substrate.

The first and/or second arrangement(s) of hard magnetic structures may have any depth, depending on the application, and may even extend as far as the second surface of the substrate material.

By using a continuous structure, one achieves a particularly high magnetic field strength thanks to a higher (maximum) aspect ratio, see also FIG. 6. As of a specific value, e.g., 7:1, however, the magnetic field generated will exhibit only a slight increase.

Figure 9:
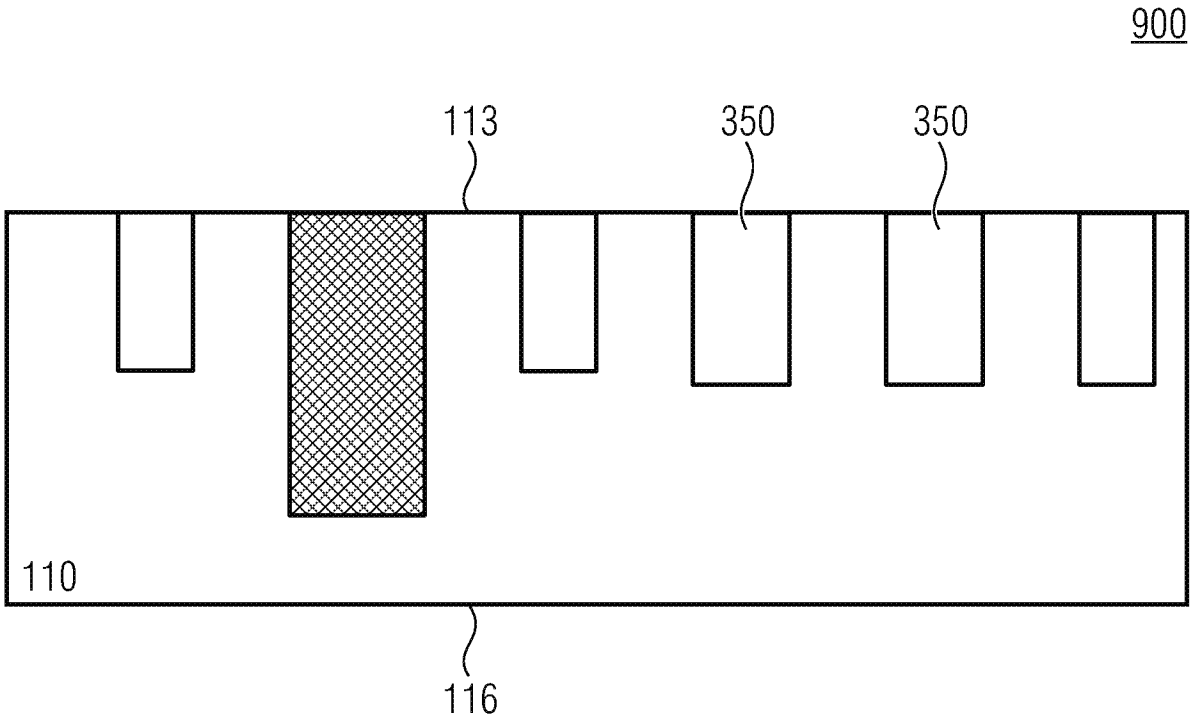
FIG. 9 shows a schematic representation of a permanent-magnetic magnetic structure comprising oppositely magnetized arrangements of different depths wherein the first and second numbers of structures or magnets are arranged in any manner desired, not only in an alternating manner.

FIG. 9 shows a schematic representation of a magnetic structure 900 comprising a planar substrate material 110 having arrangements of hard magnetic structures 350. The hard magnetic structures extend from the first surface 113 toward a second surface 116.

The first and second arrangements comprise first and second hard magnetic structures. The first and second hard magnetic structures made of the first and second hard magnetic materials are arranged in any manner desired, not only in an alternating manner.

This magnetic structure 900, which has been established by the method 100A in FIG. 1A and 100B in FIG. 1B, respectively, allows a multitude of two-dimensional magnetic structures comprising arrangements made of hard magnetic microstructures or magnets with opposite magnetization within or on planar substrates.

Figure 10:
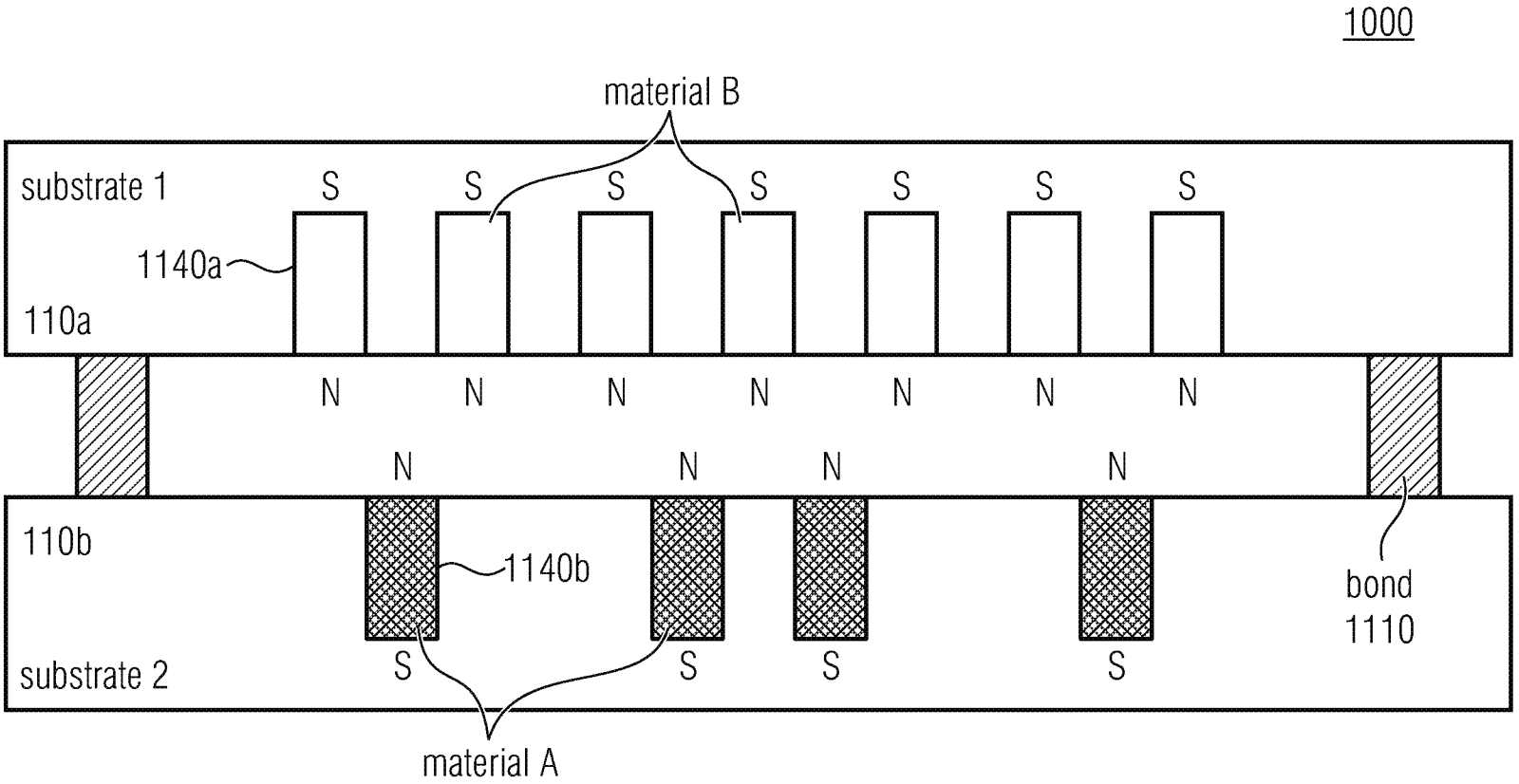
FIG. 10 shows a schematic representation of a three-dimensional magnetic structure formed of two different substrates, each of which contains only micromagnets made of one material and which are oppositely magnetized.

FIG. 10 shows a three-dimensional magnetic structure 1000 comprising two different arrangements 1140*a*, 1140*b* within or on different substrates 110*a*, 110*b*, which are firmly connected to each other by means of bonding at the substrate level.

The two arrangements 1140*a*, 1140*b* contain micromagnets made of different hard magnetic materials.

FIG. 10 presents production of a magnetic structure 1000 of oppositely magnetized arrangements of hard magnetic structures 1140*a*, 1140*b* within or on different substrates 110*a*, 110*b* by connecting two different substrates 110*a* and 110*b*, which contain only magnets or micromagnets of one material in each case.

In other words, FIG. 10 shows a three-dimensional magnetic structure 1000 having arrangements of oppositely magnetized magnets or micromagnets which were produced within or on two different substrates. The substrates each contain magnets or micromagnets made of only one material and were firmly connected to each other by means of bonding at the substrate level prior to magnetization. During bonding, the substrate 110*a* may be aligned such that the permanent-magnetic arrangement 1140*a* is located on the inner side or outer side of the bonded wafer stack. The silicon technology has a number of established bonding processes available to it which are based, e.g., on printed glass frit, or galvanically deposited Au—Sn stacks for hermetic connection, or, while using patterned adhesives and polymers, for non-hermetic connections.

The method 100A in FIG. 1A and 100B in FIG. 1B, respectively, may also generate 3D magnetic structures, for example. Since the geometries and positioning of the magnets or micromagnets within or on any of the substrates may vary as desired, a multitude of arrangements of mutually repelling or attracting magnets or micromagnets are produced in this manner.

Following explanations of the embodiments of the present invention, known conventional methods will initially be presented.

Figure 11:
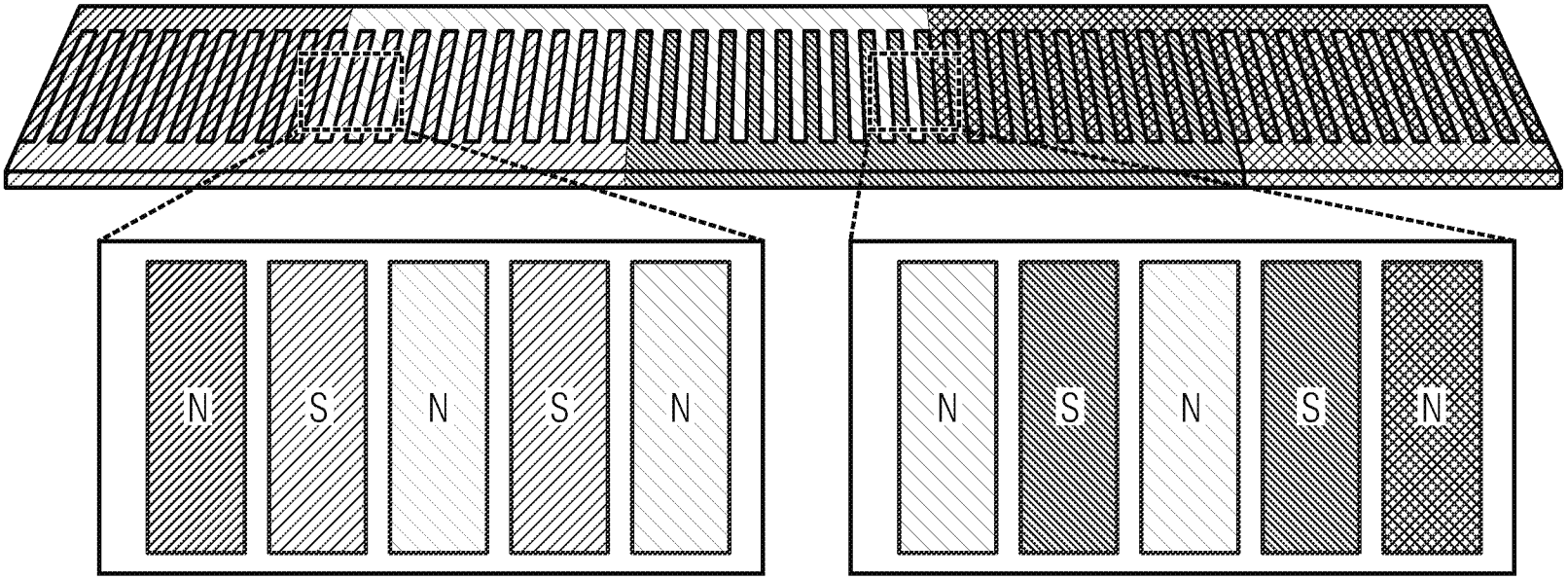
FIG. 11 shows a schematic representation of a magnetic scale with a sub mm pitch, composed of several individually magnetized SmCo combs.

FIG. 11, for example, shows a schematic representation of a magnetic scale with a sub mm pitch, composed of several individually magnetized SmCo combs.

A laser-based material processing has been allowing for a long time already to produce three-dimensional components of complex shapes with high precision. An oppositely magnetized scale with a period of 250 μm is implemented by interleaving of individually magnetized combs. Production of the individual combs is effected by means of laser processing of an SmCo film of a thickness of 300 μm.

Figure 12A:
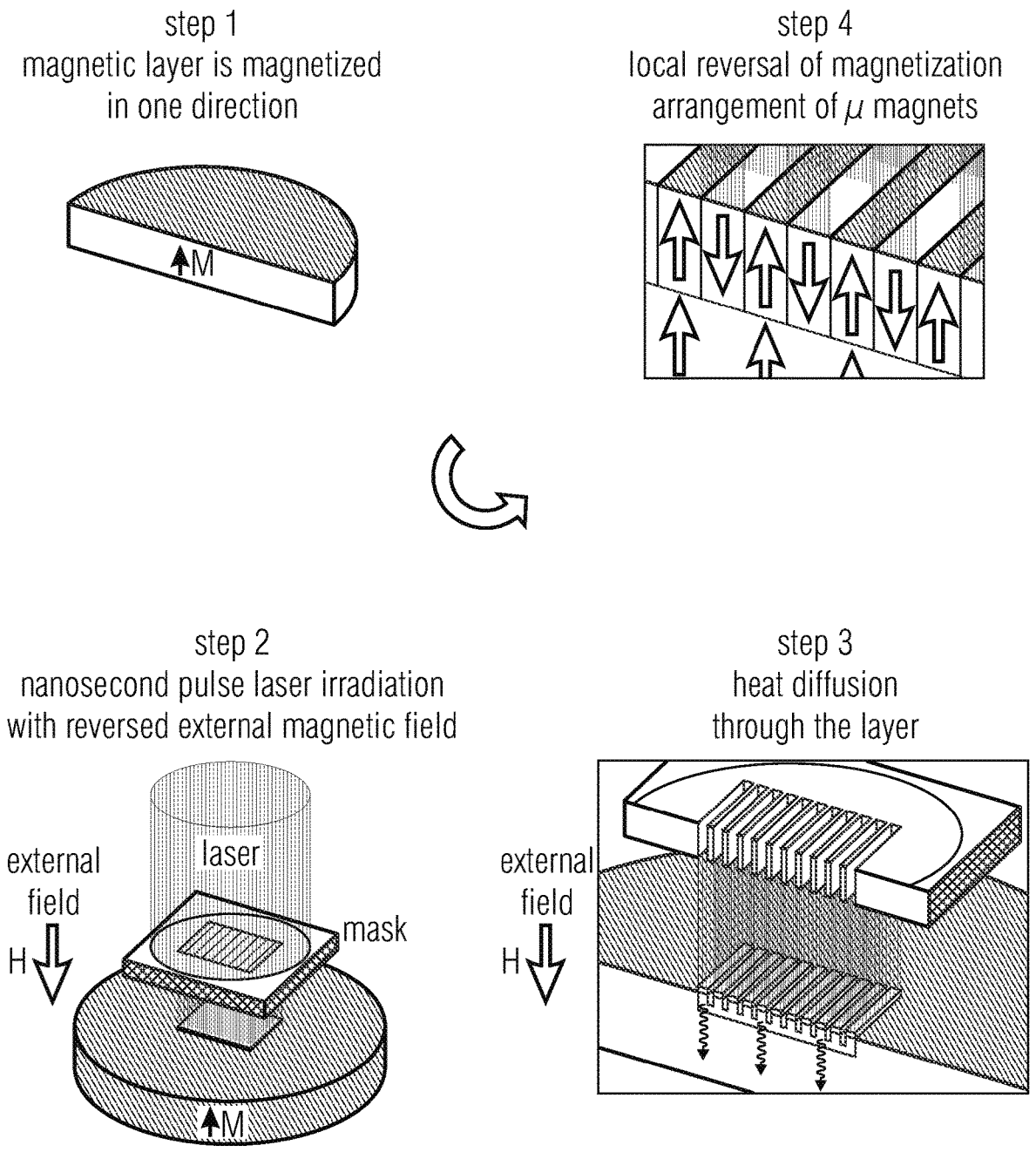
FIG. 12*a* shows a schematic representation of the production of oppositely magnetized areas by means of "thermomagnetic patterning" while using a template.
Figure 12B:
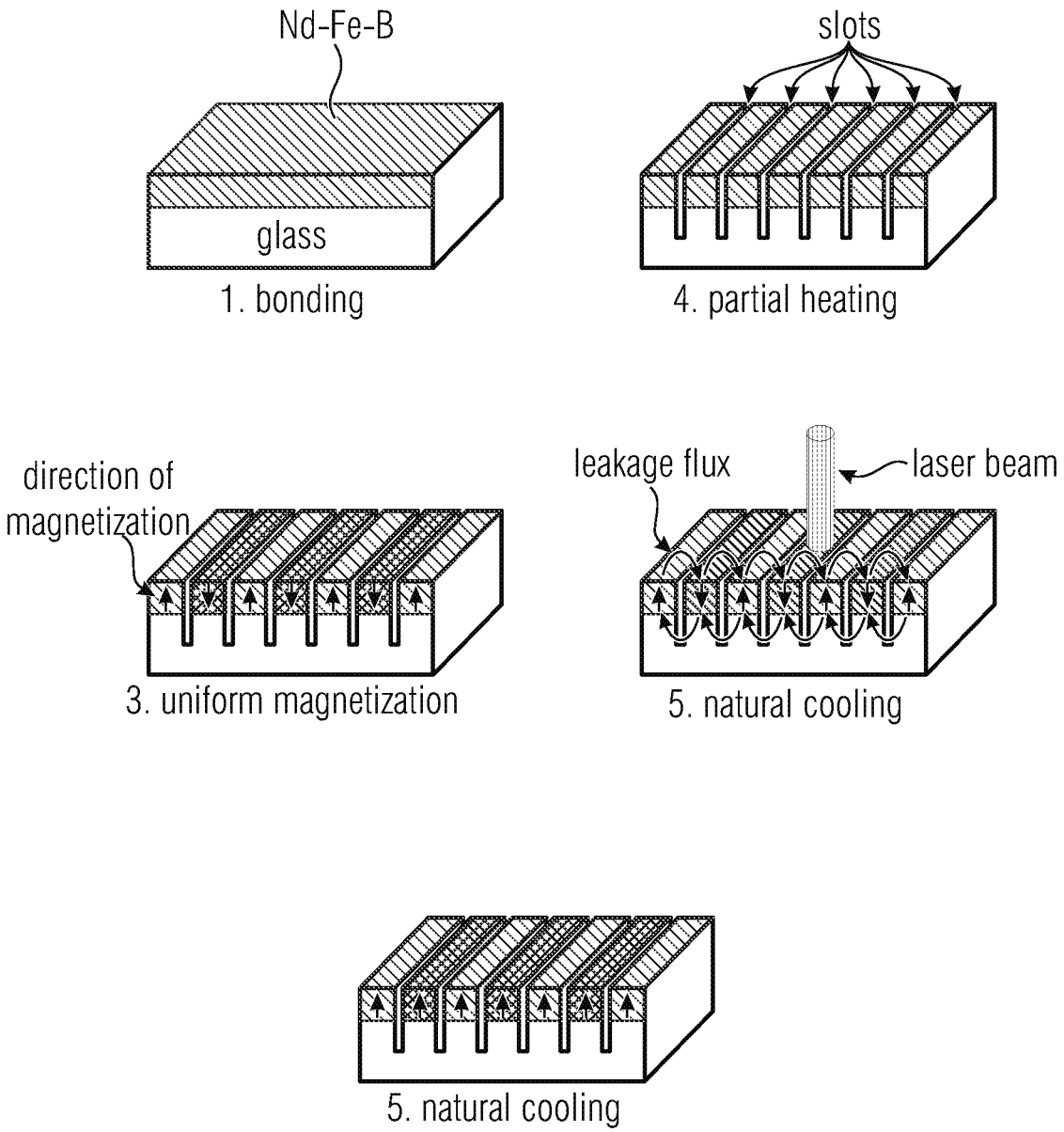
FIG. 12*b* shows a schematic representation of the production of oppositely magnetized areas by means of "thermomagnetic patterning" wherein the pixels and/or lines are separated from one another by sawing.

FIG. 12, a second example, is an illustration of the production of oppositely magnetized areas by means of thermomagnetic patterning. For a thin, hard magnetic layer, a template is used, see FIG. 12*a*. In the case of a very thick layer, the NdFeB pixels are separated from one another by sawing, see FIG. 12*b*.

In so-called "thermomagnetic patterning", a homogeneously pre-magnetized layer made of a hard magnetic material is locally heated up by means of laser, through a template and/or mask, and is oppositely magnetized in those areas by means of an opposite magnetic field applied at the same time, see FIG. 12*a*. In this manner, it was possible to produce a checkered pattern consisting of oppositely magnetized squares of a size of 50×50 $\mu m^2$, e.g., in an NdFeB layer of a thickness of 4 μm on a Si substrate. Due to the heat conduction within the NdFeB layer itself, or across the substrate, the depth of the oppositely magnetized areas is limited to approx. 1 μm.

One variant of thermomagnetic patterning is described in FIG. 12*b*. A thick NdFeB platelet is bonded onto a glass substrate, is sawn down to the glass in a predefined pattern and is thereafter magnetized on its entire surface.

Subsequently, individual pixels or lines are oppositely magnetized by selective heating using laser. The magnetic field that may be used is provided by the directly adjacent NdFeB structures.

Figure 13:
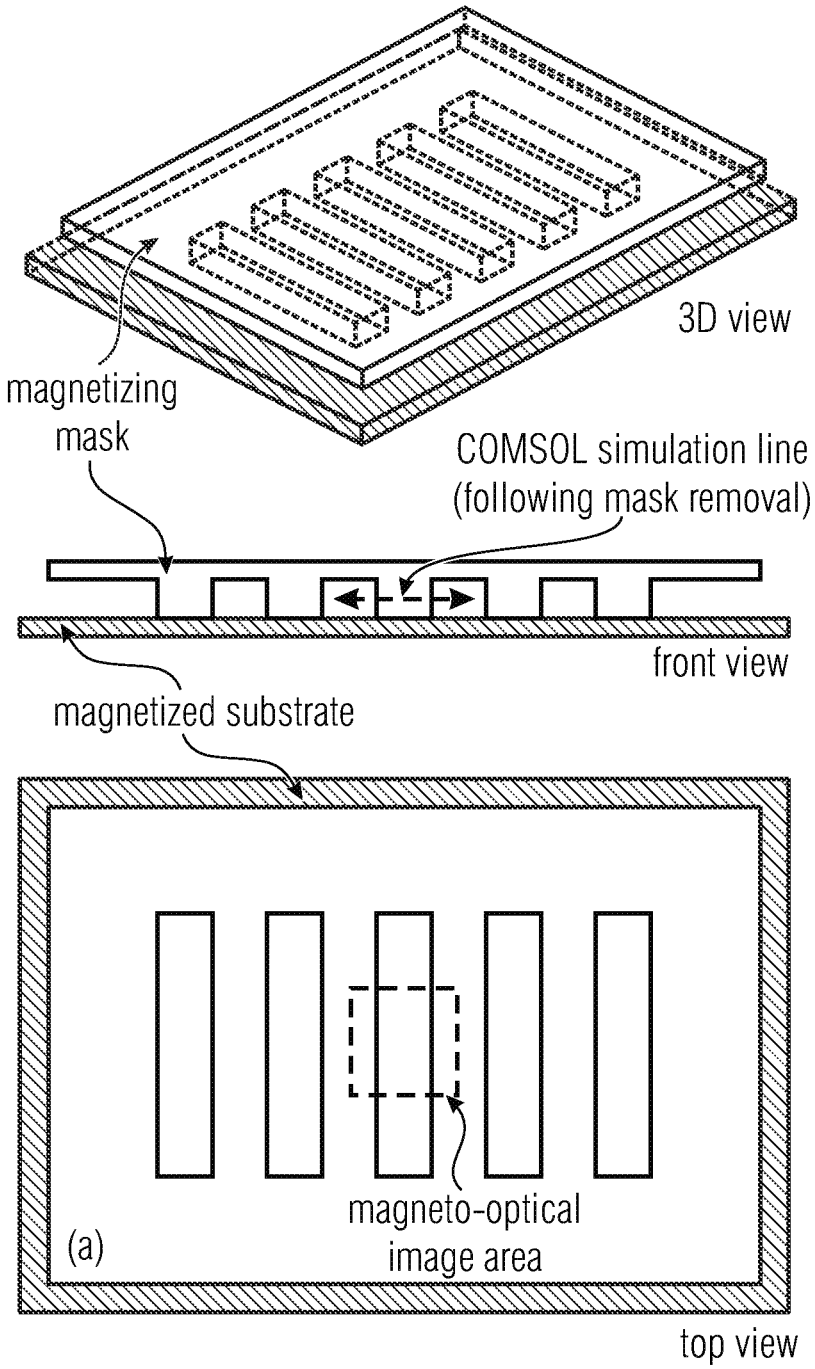
FIG. 13 shows a schematic representation of the production of oppositely magnetized areas without heating up while using a template made of a soft magnetic material having high permeability.

FIG. 13 shows, e.g., production of oppositely magnetized areas within a hard magnetic layer while using a template and/or mask made of a soft magnetic material having high permeability.

When using a template and/or mask of a soft magnetic material with high permeability, magnetic patterns may also be produced, within a hard magnetic layer, without heating.

FIG. 13 illustrates said approach. The opposite magnetic field that is applied is amplified, within the mask ridges, to such an extent that the areas of the hard magnetic layer which are located underneath are oppositely magnetized. The method is restricted to layers comprising low remanence and coercive field strength.

Figure 14:
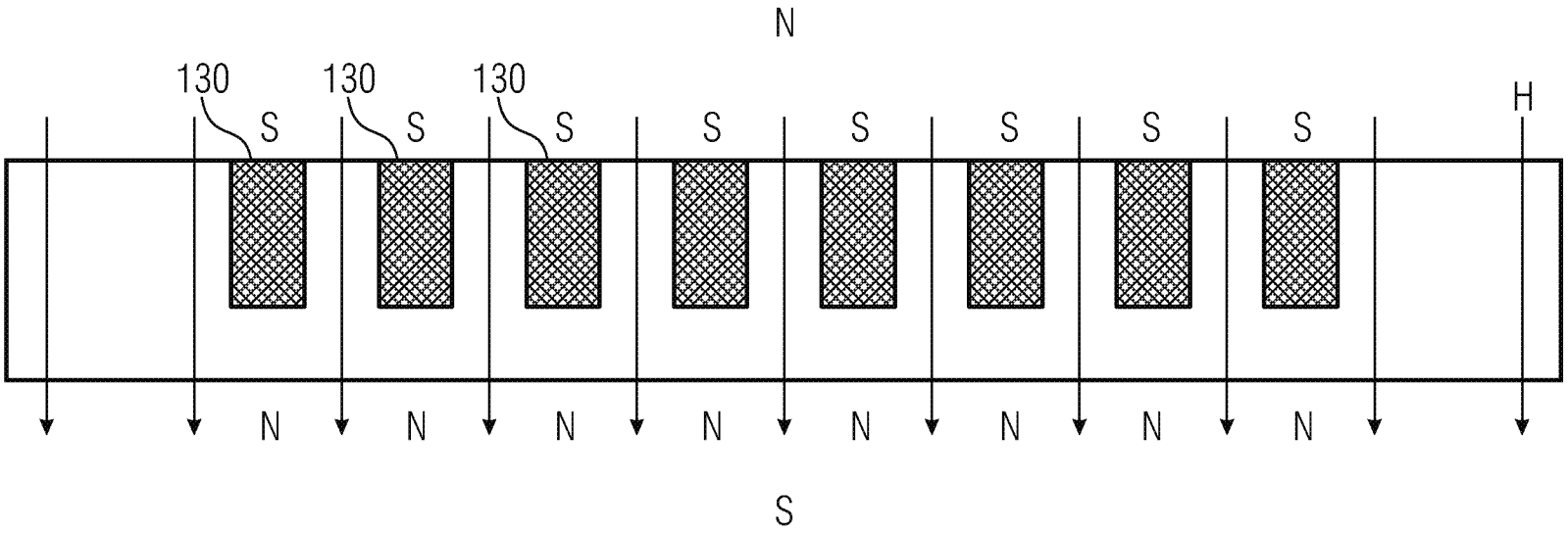
FIG. 14 shows a schematic representation of the magnetization of microstructures, produced from a hard magnetic material, by applying a homogeneous magnetic field.

FIG. 14 shows magnetization of hard magnetic structures or microstructures, made of a hard magnetic material 130, by applying a magnetic field, which is homogenous across the entire substrate surface area and exhibits the magnetic field strength H, while using a corresponding device in accordance with conventional technology.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A method of producing a magnetic structure within or on a substrate material, comprising:

producing a first number of cavities within or on the substrate material, and filling the first number of cavities with a first hard magnetic material exhibiting a first coercive field strength so as to generate a first hard magnetic arrangement;

producing a second number of cavities within or on the substrate material, and filling the second number of cavities with a second hard magnetic material exhibiting a second coercive field strength, which is smaller than the first coercive field strength, so as to create a second hard magnetic arrangement;

magnetizing the first and second hard magnetic arrangements in a first direction by means of a first magnetic field exhibiting a first magnetic field strength which exceeds the first and second coercive field strengths; and magnetizing the second hard magnetic arrangement in a second direction different from the first direction by means of a second magnetic field exhibiting a second magnetic field strength which falls below the first coercive field strength but exceeds the second coercive field strength, wherein said magnetization of the second hard magnetic arrangement comprises exposing the first and second hard magnetic arrangements to the second magnetic field.

2. The method as claimed in claim 1, wherein the difference between the first and second coercive field strengths is more than 50%.

3. The method as claimed in claim 1, wherein depths and/or cross-sections of the first number of cavities for the first hard magnetic arrangement differ from depths and/or cross-sections of the second number of cavities for the second hard magnetic arrangement, so that the first and second magnetic field strengths of individual magnets within the first and second hard magnetic arrangements following magnetization are identical in amount.

4. The method as claimed in claim 3, wherein the cross-sections of the first and second numbers of cavities are identical and the depths of the first and second numbers of cavities differ from each other, so that the first and second magnetic field strengths of the individual magnets within the first and second hard magnetic arrangements following magnetization are identical in amount.

5. The method as claimed in claim 1, wherein said filling of the first and second numbers of cavities comprises physical and/or chemical solidification of the material filled in.

6. The method as claimed in claim 5, wherein the said solidification comprises an exposure of the substrate material to an atomic layer deposition.

7. The method as claimed in claim 1, wherein the substrate material is glass material, silicon material, plastic material or ceramic material.

8. The method as claimed in claim 1, wherein the first and second hard magnetic materials are NdFeB material and/or SmCo material and/or PtCo material.

9. The method as claimed in claim 1, wherein the first and second hard magnetic materials are powdery material and/or material particles.

10. The method as claimed in claim 1, wherein producing the hard magnetic arrangements within or on the substrate comprises:

producing the first hard magnetic arrangement within or on a first substrate; and producing the second hard magnetic arrangement within or on a second substrate;

wherein the second and first substrates are connected prior to magnetization.

11. The method as claimed in claim 1, wherein producing the hard magnetic arrangements within or on the substrate comprises:

producing a first number of first and second hard magnetic arrangements within or on a first substrate; and producing a second number of first and second hard magnetic arrangements within or on a second substrate;

wherein the second and first substrates are connected prior to magnetization.

12. The method as claimed in claim 1, wherein individual magnets of the first and second hard magnetic arrangements are alternately arranged on or within a substrate material.

13. The method as claimed in claim 1, wherein the first and/or the second hard magnetic arrangement(s) is/are located either on a first surface of the substrate material or extend(s) from the first surface of the substrate material down to a predetermined depth of the substrate material or as far as a second surface located opposite the first surface.

* * * * *